US006619493B2

(12) United States Patent
Yang

(10) Patent No.: US 6,619,493 B2
(45) Date of Patent: Sep. 16, 2003

(54) SEALABLE CONTAINER

(76) Inventor: Heng-Te Yang, P.O. Box 90, Tainan City (TW)

( * ) Notice: Subject to any disclaimer, the term of this patent is extended or adjusted under 35 U.S.C. 154(b) by 0 days.

(21) Appl. No.: 10/056,010

(22) Filed: Jan. 28, 2002

(65) Prior Publication Data

US 2003/0141270 A1 Jul. 31, 2003

(51) Int. Cl.[7] ..... B65D 51/16

(52) U.S. Cl. ..... 215/228; 215/262; 220/203.11; 220/212; 220/231; 220/367.1

(58) Field of Search ..... 215/228, 260, 215/262, 311, 270; 220/212, 231, 203.11, 203.16, 203.28, 203.18, 240, 367.1

(56) References Cited

U.S. PATENT DOCUMENTS 5,390,809 A * 2/1995 Lin ..... 220/212
5,546,997 A * 8/1996 Miramon ..... 141/65
5,651,470 A * 7/1997 Wu ..... 220/212
5,692,632 A * 12/1997 Hsieh et al. ..... 220/212
5,735,317 A * 4/1998 Wu ..... 141/65
5,944,212 A * 8/1999 Chang ..... 220/212
5,992,666 A * 11/1999 Wu ..... 220/212

* cited by examiner

*Primary Examiner*—Lee Young
*Assistant Examiner*—Niki M. Eloshway

(57) ABSTRACT

A sealable container in the present invention has a container body and a cover closed on the container body and provided with a push button and a suction hole. The cover is combined with a release assembly and an outer cap therein. The release assembly includes a housing, a membrane piece, a covering piece and a follower. A combination of aforementioned components enables the sealable container of the present invention to be effectively proofed against moisture and mildew after the air in the container body is drawn to be a vacuumed state. When the cover is to be opened for taking out the food stored in the container body, it is only necessary to press the push button of the cover to release the vacuumed state in the container body, which is very convenient to open the cover.

6 Claims, 6 Drawing Sheets

SEALABLE CONTAINER

BACKGROUND OF THE INVENTION

1. Field of the Invention

This invention relates to a sealable container, particularly to one having a cover closed on a container body and provided with a push button and a suction hole, thereby connecting a suction pipe to the suction hole to expel air out of the container body to produce a vacuumed state so that the food stored in the container body can be proofed against moisture and mildew.

2. Description of the Prior Art

Generally speaking, a known conventional sealable container 1 has a container body 10 and a cover 11 closed on the container body 10 and fitted with an annual gasket 12, as shown in FIG. 1. In using the known sealable container 1 to preserve food, the cover 11 with sealing capability is closed on the container body 10 to keep the food preserved in a sealing condition. In practice, the air outside the container body 10 can be stopped contacting the food enclosed therein. However, there still is air left in the container body 10 when the cover 11 is closed on the container body 10. Therefore, after a long period of preservation, the food enclosed therein is still likely to deteriorate under the prolonged contact with the air left in the container body 10.

SUMMARY OF THE INVENTION

It is a primary object of the present invention to offer a sealable container capable of ensuring a vacuumed state so as to be effectively proofed against moisture and mildew.

It is another object of the present invention to offer a sealable container capable of being quickly released from a vacuumed state only by pressing down a push button, easy in operation and prompt in removing a cover.

The main feature of the invention is to provide a sealable container in which a cover has a recess disposed in an inner side thereof and provided with a suction hole, a through hole inserted by a push button, and at least one stop block located in a proper place of a peripheral edge thereof; and, a release assembly capable of being welded together with the recess of the cover by a high frequency welding machine includes:

a housing having at least one notch located in a proper place of an upper edge thereof for corresponding to the at least one stop block of the cover, a plurality of air holes arranged in a bottom therein and at least one engagement groove equally spaced in an inner surface of the bottom;

a membrane piece disposed in the inner surface of the bottom of the housing and having a pull rod upwards protruded on an upper surface thereof;

a covering piece placed above the membrane piece and engaged with the housing and having at least one engagement block downwards protruded from a peripheral edge of a lower surface thereof for corresponding to the at least one engagement groove of the housing and at least one elongated hole disposed therein for being extended through by the pull rod of the membrane piece; and, a follower pivoted above the covering piece and having an engagement groove disposed at one side thereof for being engaged by the pull rod of the membrane piece and a push portion upwards protruded on an upper surface of the other side thereof opposite to the engagement groove for corresponding to the push button of the cover.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
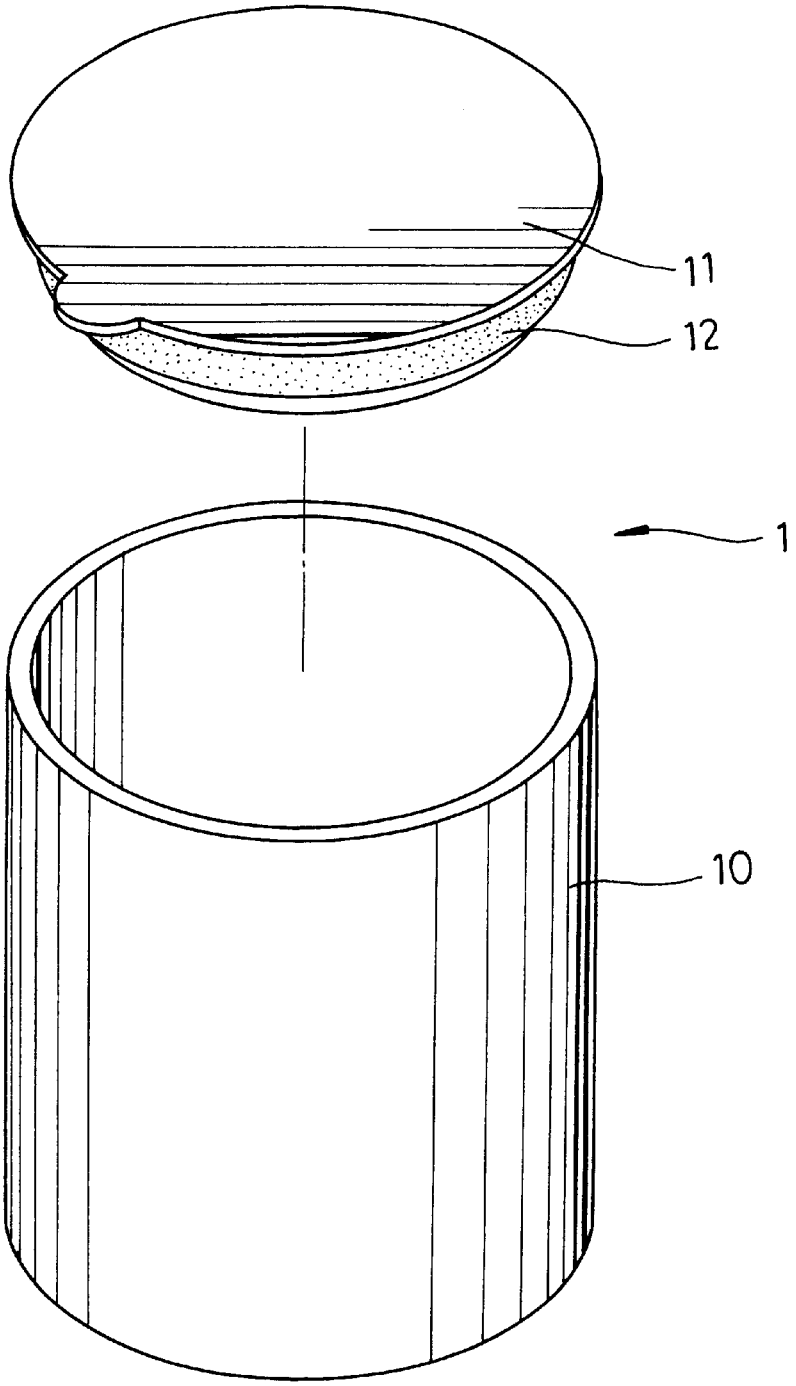
FIG.1 (PRIOR ART)
FIG. 1 is a schematic view showing the construction of a known conventional sealable container.
Figure 2:
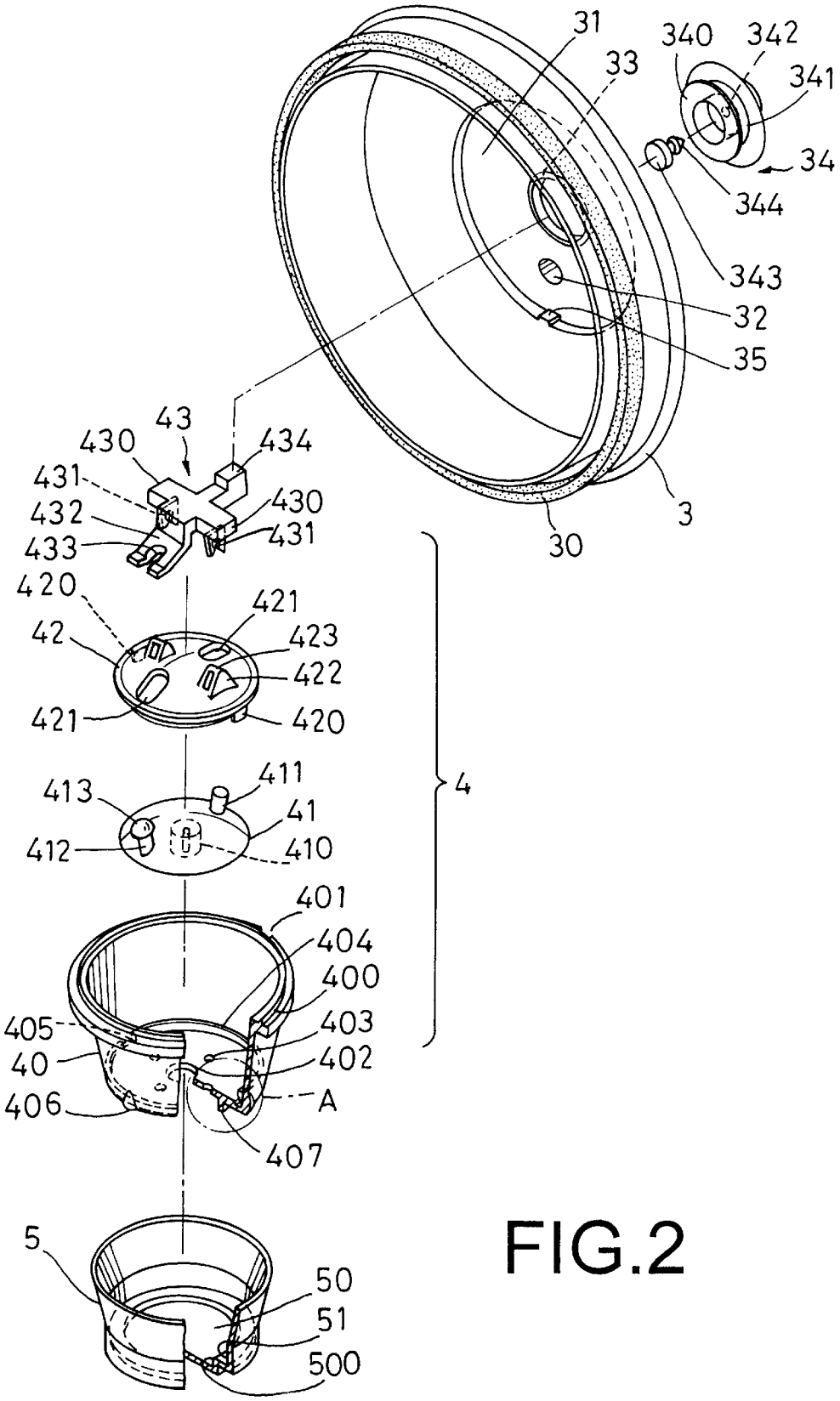
FIG. 2 is an exploded perspective view of a sealable container in the present invention, showing a cover, a release assembly and an outer cap.
Figure 3:
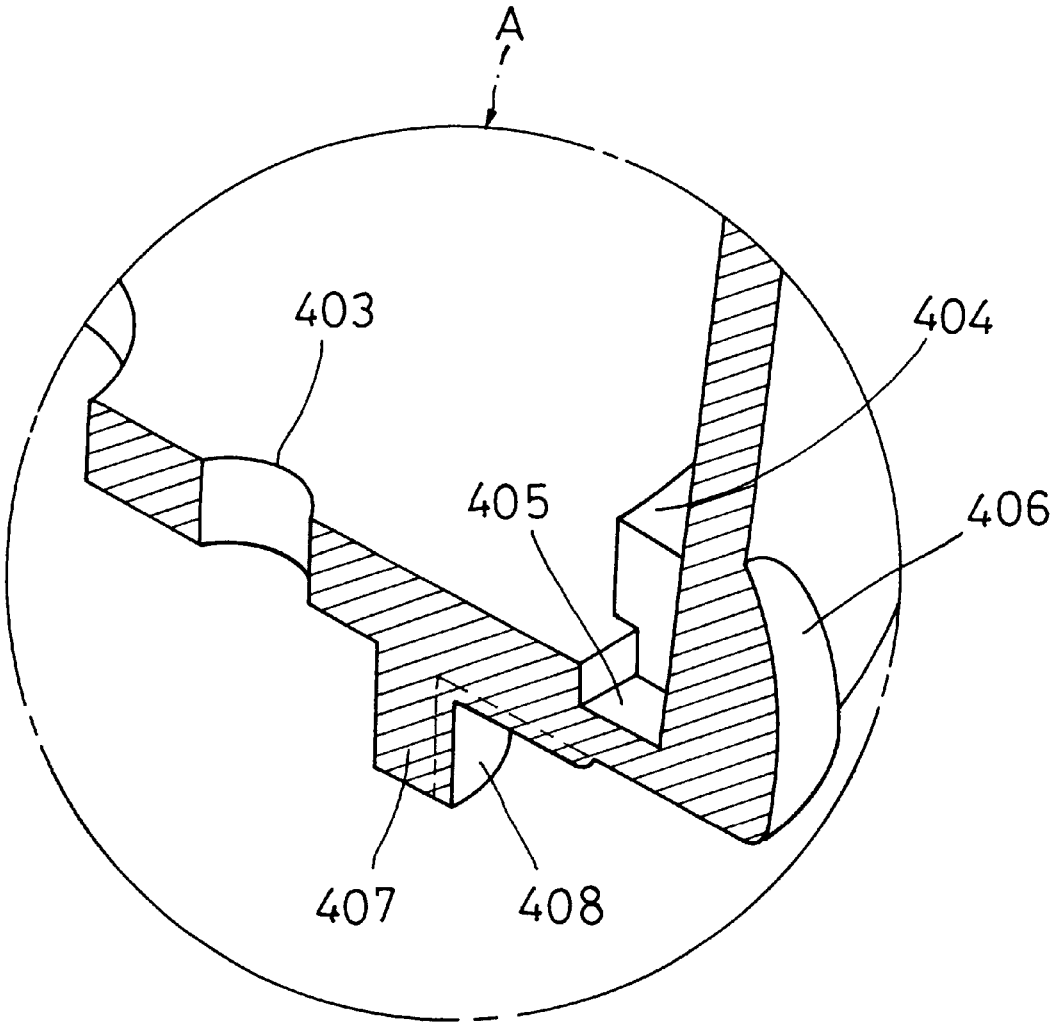
FIG. 3 is an enlarged sectional view of the portion of FIG. 2 within the circle A shown in FIG. 2.
Figure 4:
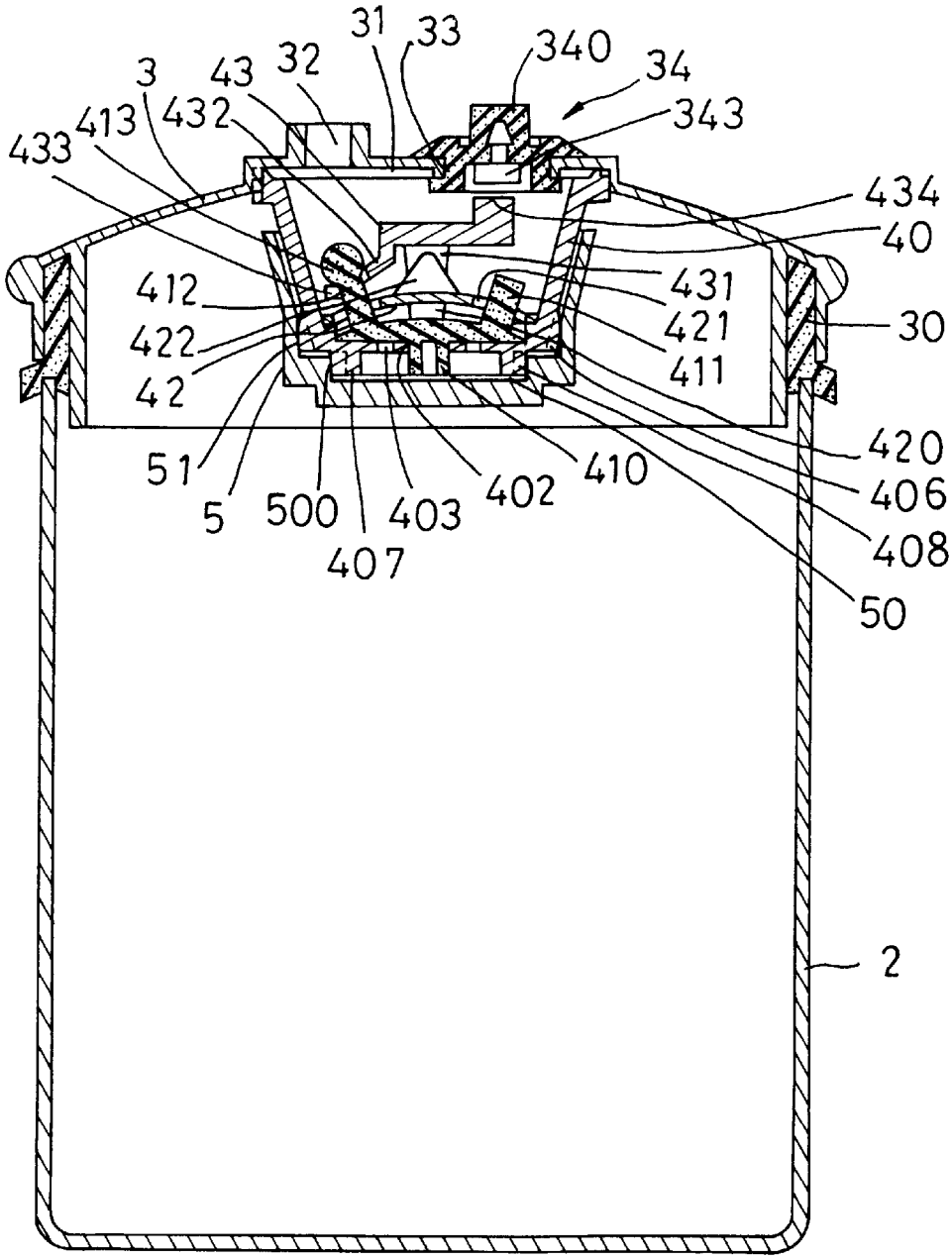
FIG. 4 is a sectional view showing an assemblage of the sealable container in the present invention.

A preferred embodiment of a sealable container in the present invention, as shown in FIGS. 2 to 4, mainly includes a container body 2, a cover 3, a release assembly 4, and an outer cap 5.

The cover 3 capable of being closed on the container body 2 and has a seal gasket 30 fitted in the periphery thereof, and a recess 31 disposed in a center of an inner side thereof and provided with a suction hole 32, a through hole 33 inserted by a push button 34, and at least one stop block 35 protruded on a peripheral edge thereof. The push button 34 has an elastic insert member 340 provided with an insert hole 342 disposed therein and an engagement groove 341 disposed around an outer edge thereof for being correspondingly engaged by the through hole 33, and a press block 343 capable of being fitted in and combined with the elastic insert member 340 and provided with a conical head 344 disposed at one end thereof for being inserted into the insert hole 342 of the elastic insert member 340.

The release assembly 4 capable of being welded together with the recess 31 of the cover 3 by a high frequency welding machine includes a housing 40, a membrane piece 41, a covering piece 42, and a follower 43.

The housing 40 with a tapered lower portion has an flange 400 disposed around an upper edge thereof, at least one notch 401 located in the periphery of the upper edge for corresponding to the at least one stop block 35 of the recess 31 of the cover 3, a through hole 402 disposed in a center of a bottom therein, a plurality of air holes 403 arranged around the through hole 402, a lip 404 disposed in a peripheral edge of an inner surface of the bottom, at least one engagement groove 405 equally spaced in the lip 404, a plurality of projections 406 disposed on an outer wall surface around the bottom, and an annular footing flange 407 downwards protruded from a lower surface of the bottom and provided with a plurality of projections 408 disposed on an outer wall surface thereof.

The membrane piece 41 in a curved shape is disposed in the inner surface of the bottom of the housing 40 and has a lower surface provided with a post 410 downwards protruded thereof for extending through the through hole 402 of the housing 40, and an upper surface provided with a projecting rod 411 and a pull rod 412. The pull rod 412 has a ball-shaped pull portion 413 formed at a top thereof.

The covering piece 42 capable of being placed above the membrane piece 41 and engaged with the housing 40 has at least one engagement block 420 downwards protruded from a peripheral edge of a lower surface thereof for corresponding to the at least one engagement groove 405 of the housing 40, two elongated holes 421 disposed therein for being extended through by the projecting rod 411 and the pull rod 412 of the membrane piece 41, and two angular blocks 422 oppositely protruded at both sides of an upper surface thereof. Each of the angular blocks 422 has a pivot bar 423 disposed at a top thereof.

The follower 43 capable of being pivoted above the covering piece 42 has two cross parts: one part provided with two pivoting plates 430 respectively disposed at both sides thereof, and the other part provided with a downward inclined plate 432 disposed at one side thereof and a push portion 434 upwards protruded at the other side opposite to the inclined plate 432. Each of the pivoting plates 430 has a retaining ring 431 downwards protruded from a lower surface thereof for engaging each of the pivot bars 423 of the covering piece 42 in a pivoting way so that each pivoting joint is capable of serving as an axle to allow the follower 43 to be swung to and fro. The inclined plate 432 has an engagement groove 433 formed at an outer end thereof for being engaged with the pull rod 412 of the membrane piece 41 and whose opening is smaller than the ball-shaped pull portion 413 formed at the top of the pull rod 412. The push portion 434 corresponds to the push button 34 of the cover 3.

The outer cap 5 capable of being covered on a lower portion of the release assembly 4 for accommodating the housing 40 of the releasing assembly 4 has a recessed chamber 50 disposed in an inner surface of a bottom thereof for accommodating the annular footing flange 407 of the housing 40. The outer cap 5 can be firmly combined with the housing 40 by having the plurality of projections 406 of the housing 40 tightly attached against an inner wall surface 51 of the outer cap 5, and having the plurality of projections 408 of the annular footing flange 407 of the housing 40 tightly attached against an inner wall surface 500 of the recessed chamber 50 of the outer cap 5. Moreover, airflow passages are formed in between an outer wall of the housing 40 and the inner wall of the outer cap 5 and in between the outer wall of the housing 40 and the inner wall of the recessed chamber 50.

In assembling, referring to FIGS. 2 to 4, firstly assemble the push button 34 by having the conical head 344 of the press block 343 fitted into the insert hole 342 of the elastic insert member 340 in position, and then insert the assembled push button 34 into the cover 3 with the engagement groove 341 of the elastic insert member 340 engaged by the through hole 33 of the cover 3.

Secondly, assemble the release assembly by having the projecting rod 411 and the pull rod 412 of the membrane piece 41 respectively extending through the two elongated holes 421 of the covering piece 42, then having the pull rod 412 of the membrane piece 41 engaged by the engagement groove 433 of the follower 43 with the pull portion 413 of the pull rod 412 protruded on and stopped against the inclined plate 432 of the follower 43, further having the two pivoting plates 430 of the follower 43 respectively corresponding to the two angular blocks 422 of the covering piece 42 to make the retaining rings 431 of the pivoting plates 430 respectively engaging the pivot bars 423 of the angular blocks 422 in a pivoting way, and finally having the combination of the membrane piece 41, the covering piece 42 and the follower 43 placed into the housing 40 with the post 410 of the membrane piece 41 extending through the through hole 402 of the housing 40 to make each engagement block 420 of the covering piece 42 correspondingly engaged in each engagement groove 405 of the housing 40 and to make the peripheral edge of the covering piece 42 rested against the lip 404 of the housing 40.

Thirdly, cover the outer cap 5 on the lower portion of the assembled release assembly 4 by accommodating the housing 40 of the releasing assembly 4 in the outer cap 5 with the annular footing flange 407 of the housing 40 accommodated in the recessed chamber 50 of the outer cap 5, and then firmly combine the outer cap 5 and the housing 40 of the releasing assembly 4 together by having the plurality of projections 406 of the housing 40 tightly attached against the inner wall surface 51 of the outer cap 5 and having the plurality of projections 408 of the annular footing flange 407 of the housing 40 tightly attached against the inner wall surface 500 of the recessed chamber 50 of the outer cap 5. Moreover under such secured attachments between the plurality of projections 406 of the housing 40 and the inner wall surface 51 of the outer cap 5 and between the plurality of projections 408 of the annular footing flange 407 of the housing 40 and the inner wall surface 500 of the recessed chamber 50 of the outer cap 5, the airflow passages are formed in between the outer wall of the housing 40 and the inner wall of the outer cap 5 and in between the outer wall of the housing 40 and the inner wall of the recessed chamber 50.

Finally, connect the combination of the release assembly 4 and the outer cap 5 to the cover 3 by having the top surface of the housing 40 fitted with the recess 31 of the cover 3 with the push portion 434 of the follower 43 corresponding to the press block 343 of the push button 34 of cover 3 and with each notch 401 of the housing 40 correspondingly engaged by each stop block 35 of the recess 31 of the cover 3, and then firmly weld the release assembly 4 and the cover 3 together by a high frequency welding machine, by which the combined cover 3 is capable of being closed on the container body 2 to construct the sealable container of the present invention.

Figure 5:
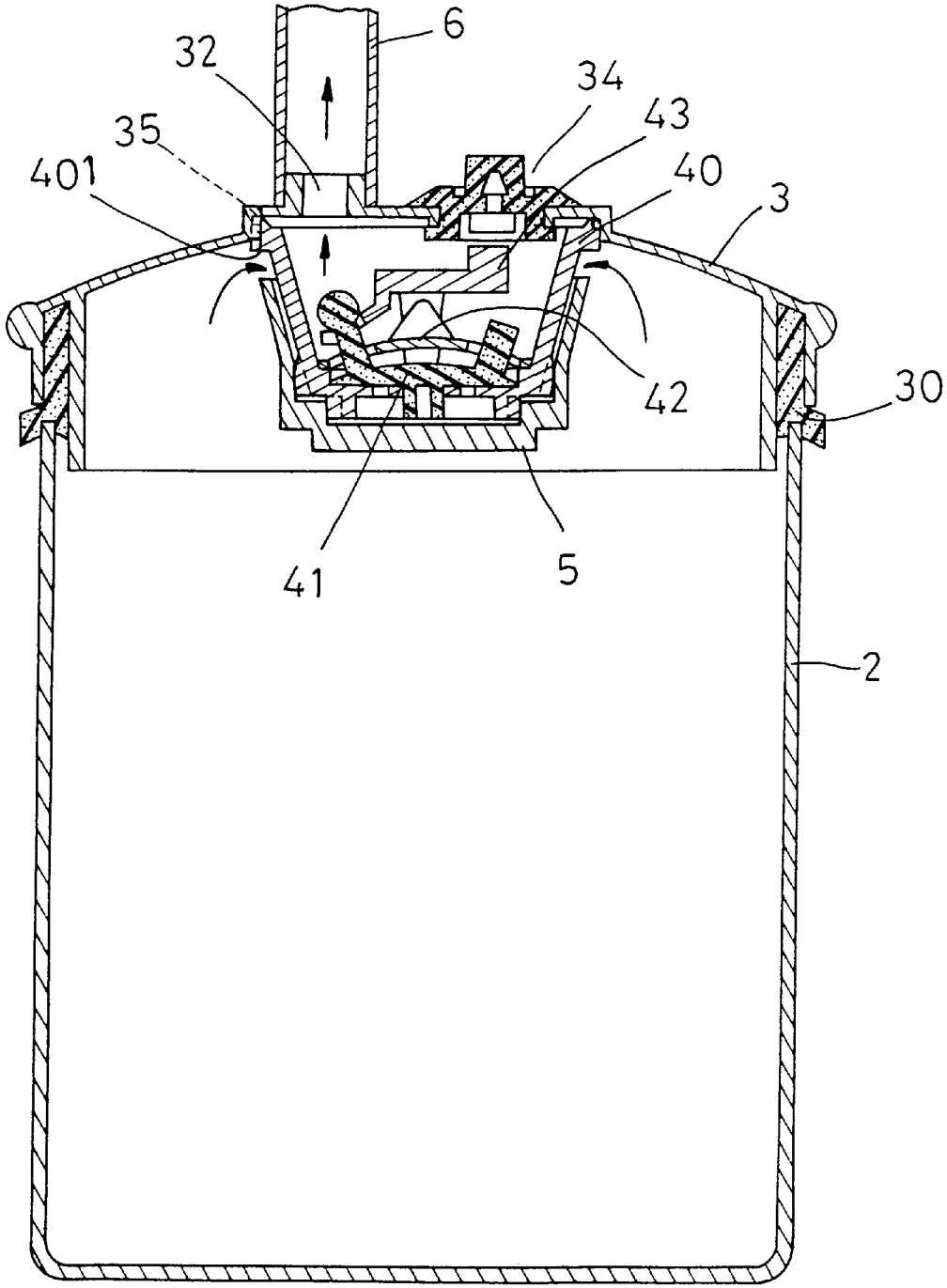
FIG. 5 is a schematic view of the sealable container in the present invention, showing the air in a container body being expelled out; and, FIG. 6 is a schematic view showing a reference of the sealable container in the present invention in operation.

When the air in the container body 2 is to be expelled out, referring to FIGS. 4 and 5, it is only necessary to connect a suction pipe 6 of an air-extracting pump (not show) to the suction hole 32 of the cover 3 to expel air out of the container body 2 to produce a vacuumed state to avoid the food enclosed in the container body 2 mildewing and deteriorating under the moisture of the wet weather.

Figure 6:
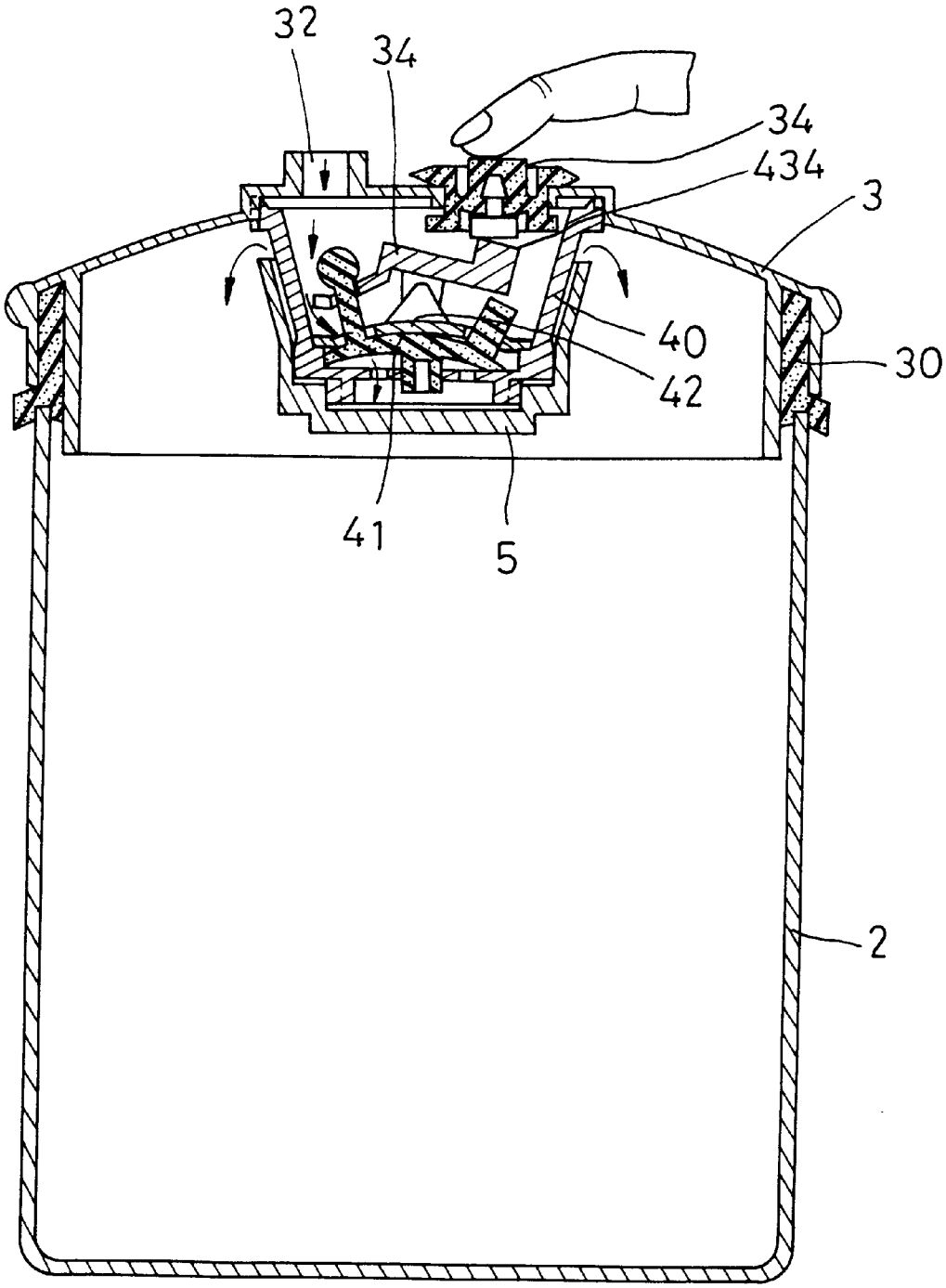

When the sealable container of the present invention is to be released from the vacuumed state, referring to FIGS. 4 and 6, it is only necessary to press the push button 34 of the cover 3 with a finger to lower the press block 343 of the push button 34 to press down the push portion 434 of the follower 43 of the release assembly 4. Under the pivoting relationship between the retaining rings 431 of the follower 43 and the pivot bars 423 of the covering piece 42, the follower 43 is capable of being swung to and fro so that a downward force to the push portion 434 of the follower 43 can move the inclined plate 432 of the follower 423 upwards to force the pull rod 412 of the membrane piece 41 to be pulled upwards accordingly, by which the membrane piece 41 is pulled up to allow the outside air to flow from the plurality of air holes 403 arranged in the bottom of the housing 40, through the airflow passages in between the outer wall of the housing 40 and the inner wall of the outer cap 5 and in between the outer wall of the housing 40 and the inner wall of the recessed chamber 50, and into the container body 2 so as to release the vacuumed state of the container body 2, thereby easily opening the cover 3.

The invention has the following advantages, as can be understood from the aforesaid description.

1. In using the sealable container of the present invention, it is only necessary to connect a suction pipe of an air-extracting pump (not show) to the suction hole of the cover to expel air out of the container body to produce a vacuumed state.

2. The present invention can stop air contacting with the food stored in the container body to make the food effectively proofed against moisture and mildew, and thus not deteriorate quickly.

3. It is only necessary to press the push button of the cover to release the vacuumed state of the sealable container of the present invention, very convenient to quickly open the cover to take out the food stored in the container body with easy operation. Moreover, the pull rod of the membrane piece can obtain a longer working life without fingers to pull it directly.

While the preferred embodiment of the invention has been described above, it will be recognized and understood that various modifications may be made therein and the appended claims are intended to cover all such modifications that may fall within the spirit and scope of the invention.

What is claimed is:

1. A sealable container comprising:

a container body;

a cover closed on said container body and having a seal gasket fitted in the periphery thereof; and, characterized by said cover having a recess disposed in an inner side thereof and provided with a suction hole, a through hole having a rush button inserted therethrough and at least one stop block located in a predetermined position of a peripheral edge thereof; and, a release assembly capable of being welded together with said recess of said cover by a high frequency welding machine and including a housing, a membrane piece, a covering piece, and a follower;

said housing having at least one notch located in a proper place of an upper edge thereof for corresponding to said at least one stop block of said cover, a plurality of air holes arranged in a bottom therein and at least one engagement groove equally spaced in an inner surface of said bottom;

said membrane piece disposed in said inner side of said bottom of said housing and having a pull rod upwards protruded on an upper surface thereof;

said covering piece placed above said membrane piece and engaged with said housing and having at least one engagement block downwards protruded from a peripheral edge of a lower surface thereof for corresponding to said at least one engagement groove of said housing and at least one elongated hole disposed therein for being extended through by said pull rod of said membrane piece; and, said follower pivoted above said covering piece and having an engagement groove disposed at one side thereof for being engaged by said pull rod of said membrane piece and a push portion upwards protruded on an upper surface of the other side thereof opposite to said engagement groove for corresponding to said push button of said cover.

2. The sealable container as claimed in claim 1, wherein an inner space of said push button of said cover consists of an elastic insert member and a press block.

3. The sealable container as claimed in claim 1, wherein said housing of said release assembly has a through hole disposed in a center of said bottom thereof, a lip disposed in a peripheral edge of said inner surface of said bottom, a plurality of projections disposed on an outer wall surface around said bottom, and an annular footing flange downwards protruded from a lower surface of said bottom and provided with a plurality of projections disposed on an outer wail surface thereof.

4. The sealable container as claimed in claim 1, wherein said membrane piece of said release assembly has a post downwards protruded from a lower surface thereof for extending through a through hole disposed in said bottom of said housing.

5. The sealable container as claimed in claim 1, wherein said covering piece of said release assembly has two angular blocks respectively upwards protruded at both sides of an upper surface thereof and each said angular block is provided with a pivot bar disposed at a top thereof; and, wherein said follower of said release assembly has two cross parts, said one part of said follower provided with two pivoting plates respectively disposed at both sides thereof, and said the other part of said follower provided with an inclined plate disposed at one side thereof, each said pivoting plate having a retaining ring downwards protruded from a lower surface thereof for engaging each said pivot bar of said covering piece in a pivoting way so that each pivoting joint is capable of serving as an axle to allow said follower to be swung to and fro, said inclined plate having an engagement groove formed at an outer end thereof for being engaged with said pull rod of said membrane piece.

6. The sealable container as claimed in claim 1, wherein an outer cap is capable of being covered on a lower portion of said release assembly.

* * * * *